US005799500A

United States Patent [19]

Kang

[11] Patent Number: 5,799,500

[45] Date of Patent: Sep. 1, 1998

[54] REFRIGERATOR WITH AN AIR GUIDE FOR A COOL AIR DISPENSING DEVICE

[75] Inventor: Tae Gil Kang, Suwon, Rep. of Korea

[73] Assignee: Samsung Electronics Co., Ltd., Suwon, Rep. of Korea

[21] Appl. No.: 809,822

[22] PCT Filed: Aug. 19, 1996

[86] PCT No.: PCT/KR96/00137

§ 371 Date: May 30, 1997

§ 102(e) Date: May 30, 1997

[87] PCT Pub. No.: WO97/07372

PCT Pub. Date: Feb. 27, 1997

[30] Foreign Application Priority Data

Aug. 19, 1995 [KR] Rep. of Korea ..... 1995/25556

[51] Int. Cl.[6] ..... F25D 17/04

[52] U.S. Cl. ..... 62/408; 62/407

[58] Field of Search ..... 62/407, 408, 404, 62/409, 440, 441, 455

[56] References Cited

U.S. PATENT DOCUMENTS 5,664,437 9/1997 Park et al. ..... 62/407

*Primary Examiner*—William Doerrler

*Attorney, Agent, or Firm*—Burns, Doane, Swecker & Mathis, L.L.P.

[57] ABSTRACT

A refrigerator includes a cool air dispersing wing (45) disposed rotatably near each of the cool air discharging openings (111) to distribute evenly the cool air from the cool air duct (130) through the cool air discharging opening, a rotary shaft (41) for the cool air dispersing wing (45), a driving means (125) for rotating the rotary shaft (41), and a cool air guide means (80) disposed inside said cool air duct (130) for guiding the cool air flow in the cool air duct (130) toward the cool air dispersing wing (45). As a result, the eddy effect in the cool air duct (130) is eliminated, and the cool air guided by the cool air duct (130) is supplied smoothly and steadily to the fresh food compartment (23) via the cool air dispersing wings (45).

2 Claims, 12 Drawing Sheets

REFRIGERATOR WITH AN AIR GUIDE FOR A COOL AIR DISPENSING DEVICE

TECHNICAL FIELD

The present invention relates to a refrigerator, more specifically to a refrigerator including a main body housing a fresh food compartment, and a cool air duct provided in a wall of the fresh food compartment and having cool air discharge openings opened toward the fresh food compartment to supply a cool air from an evaporator into the fresh food compartment.

BACKGROUND ART

As described in FIG. 1, a conventional refrigerator has a thermally insulated main body 4 housing a freezing compartment 2 and a fresh food compartment 3 separated with each other by a partitioning wall 1, as well as a freezing compartment door 6 and a fresh food compartment door 7 which open/close the freezing compartment 2 and the fresh food compartment 3 respectively. In the main body 4 of the refrigerator is installed a refrigeration system consisting of a compressor 11, a condenser(not shown), an evaporator 12*a* for the freezing compartment 2 and an evaporator 12*b* for the fresh food compartment 3. A cool air produced at each evaporator 12*a*, 12*b* is directed toward the freezing compartment 2 and fresh food compartment 3 by means of the freezing compartment fan 13 *a* or the fresh food compartment fan 13*b*.

A cool air duct 15 guides the cool air from the fresh food compartment fan 13*b*. The cool air duct 15 has cool air discharging openings 16 facing the interior of the fresh food compartment 3 through which the cool air is provided to the compartment 3. A control damper 19 closing/opening the entrance of the cool air duct 15 is provided at the entrance of the cool air duct 15 in order to control the amount of cool air blown into the fresh food compartment 3.

In the typical refrigerators, the cool air for the fresh food compartment 3 is generally delivered in a so-called shelf-by-shelf fashion as illustrated in FIG. 2. In a shelf-by-shelf cooling method, the fresh food compartment 3 is stratified by means of shelves 8 into several sub-compartments, and the vertically arranged cool air discharging openings 16 are associated to the sub-compartments to provide the cool air to the respective corresponding sub-compartment.

However, the refrigerator adopting the above shelf-by-shelf cooling method are burdened with a problem of an uneven refrigeration in the fresh food compartment 3, due to a temperature difference between regions of the fresh food compartment 3. Since the cool air is blown into the compartment 3 only in the direction toward which the discharging openings 16 is facing, there is bound to exist a region within the compartment 3 receiving more cool air or less than others. Furthermore such a cooling method does not allow the flexibility to concentrate the cool air into a specific region when there is a necessity to have a region cooler than others.

A so-called tri-dimensional refrigerator has been recently conceived to overcome the forementioned shortcoming of the shelf-by-shelf cooling method. As illustrated in FIG. 3, in such a shelf-by-shelf cooling method. As illustrated in FIG. 3, in such a method, a number of cool air discharging openings 16' are located not only on the back wall but also on the side walls of the fresh food compartment 3 allowing the delivery of the cool air from three sides.

Such a tri-dimensional cooling method, despite an improved uniform distribution of cool air in the fresh food compartment 3 however, does not permit the cool air to be fully dispersed in the compartment 3 as the discharge of the cool air is effectuated only in fixed directions. Foodstuffs stored in a region where the cool air is mainly directed have a risk of being over-cooled. By contrast, foodstuffs scored in the corners may not be cooled sufficiently. Accordingly, in the method, there's a definite limit in maintaining the temperature even throughout the storage area. Furthermore, as in the case of the shelf-by-shelf cooling system, this method makes impossible to concentrate the cool air into a specific area, should there exist a necessity to do so. A further significant problem of the tri-dimensional cooling method is that a refrigerator equipped with such a system is expensive to produce (extra parts and extra manufacturing cost) as additional ducts need to be installed at the side walls of the fresh food compartment 3. Furthermore, such a refrigerator has yet another disadvantage of a reduced storing capacity as the walls need to be thicker. Moreover, the energy loss in the cool air flow becomes more significant.

The above mentioned problems become a real issue with today's trend of increasingly larger refrigerators. In high capacity refrigerators which necessitate larger dimensions, there is a definite limit in distributing the cool air evenly to all regions in the fresh food compartment 3. As illustrated in FIG. 1, since each cool air discharging opening 16 is formed perpendicularly to the direction of the flow of the cool air, the cool air coming from the evaporator 12*b* is not evenly distributed among the discharging openings 16. The lower the discharging opening 16*b* is, the more cool air is distributed to. As a consequence, a uniform distribution of cool air in the fresh food compartment 3 in a vertical direction can not be achieved, resulting in the over-cooling of the foodstuffs stored at the bottom, and under-cooling of those foodstuffs stored at the top.

In order to solve the forementioned problems, a refrigerator has been proposed in International Patent Publication WO 95/27178 by the applicant of this invention. The refrigerator is equipped with a cool air dispersing device which distributes the cool air from the cool air duct evenly to all regions of the fresh food compartment, as illustrated in FIGS. 4 to 7.

FIG. 4 is a side cross-sectional view of a refrigerator equipped with a cool air dispersing device, and FIG. 5 is a partially enlarged view of the refrigerator in FIG. 4. As in the illustrated refrigerator of FIG. 1, the refrigerator consists of a main body 14, a compressor 31, evaporators 32*a*, 32*b* and fans 33*a*, 33*b*. In the rear wall of the fresh food compartment 23 is provided a cool air duct 131 through which the cool air from the fresh food compartment evaporator 32*b* flows down after being blown therein by the fresh food compartment fan 33*b*. Inside this cool air duct 131 is disposed a cool air dispersing device 40 in a vertical arrangement. In the rear wall of the fresh food compartment 23 are disposed a cool air discharging openings 111 through which the cool air from the cool air duct 34 is discharged into the fresh food compartment 23. The cool air dispersing device 40 guides the provided cool air into the fresh food compartment 23 through these cool air discharging openings 111.

FIG. 6 is an exploded perspective view of FIG. 5. A duct housing 100 forming the cool air duct 131 is comprised of a duct member 130 which guides insulatedly the cool air, a frontal panel 120 which covers up the front side of the duct member 130, a seal panel 150 which covers up the rear side of the duct member 130 and a partially cylindrical cool air grill member 110 which surrounds the cool air dispersing device 40 at the front side of the frontal panel 120. In the cool air grill member 110 are formed the cool air discharging openings 111 facing the fresh food compartment 23. The cool air dispersing device 40 is rotatably installed on the frontal panel 120. The frontal panel 120 and the duct member 130 are formed with recesses 121, 121' for accommodating a portion of the cool air dispersing device 40 to surround the cool air dispersing device 40 in cooperation with the cool air grill member 110.

The cool air dispersing device 40 is comprised of a vertically disposed rotary shaft 41, and cool air dispersing wings 45 which are disposed along the shaft 41 at locations corresponding to the cool air discharging openings 111. The device 40 is put into rotation by means of a driving motor 125 housed in a motor case 124 located in the upper part of the frontal panel 120.

The cool air grill member 110 is installed at the recess 121, 121' of the frontal panel 120. The cool air discharging openings 111 on the grill member 110 are disposed in such a way as to correspond to the positions of the cool air dispersing wings 45 of the cool air dispersing device 40. The frontal panel 120 is installed virtually conforming with the inner surface of the rear wall of the fresh food compartment 23, and the cool air grill member 110 is installed in such a way as to protrude from the frontal panel 120 out to the inside of the fresh food compartment 23.

FIG. 7 is a rear perspective view of FIG. 6 showing the coupled state of the duct member 130 and the frontal panel 120. The rear surface of the duct member 130 is formed with a plurality of cool air guides 137, and between these guides 137 are disposed cool air directing vent 138 which pass through the duct member 130. The cool air directing vent 138 are positioned to correspond to the locations of the dispersing wings 45 of the cool air dispersing device 40.

The cool air ducts 131 are formed vertically at the rear surface of the duct member 130. The cool air guides 137 divides the cool air ducts 131 into a first duct portion **131*a* and a second duct portion 131*b* at each side thereof. The two duct portions 131*a*, 131*b* are met by the conducting path 132 at the upper end, and by a vegetables compartment 23*b*** at the lower end.

Each duct portion **131*a*, 131*b* is directed into the cool air directing vent 138 through a first connecting channel 135*a* and a second connecting channel 135b which are formed between the cool air guides 137. In the illustrated embodiment, three cool air directing vent 138 are provided at the upper, middle and lower regions, and three sets of the connecting channels 135*a* and 135*b* are disposed to correspond to the positions of the cool air directing vents 138. Each connecting channel 135 has its upper portion rounded and its lower portion wider to the exterior than the upper portion, thereby allowing the cool air flowing down the duct portion 131 to be dispersed and directed to the connecting channels 135 in a natural fashion. The lower connecting channel is wider to the exterior and has a larger entrance than the middle connecting channel which is in turn wider than the upper connecting channel, thus allowing an even distribution of the cool air flowing into each respective cool air directing vent 138. The seal panel 150 is attached airtight to the duct member 130, and forms the rear wall of the cool air duct 131. The duct member 130 and the seal panel 150** are made out of insulating materials such as polystyrene foam and minimize the heat transfer loss of the cool air.

The cool air dispersing device 40, as illustrated in FIG. 8, is comprised of the rotary shaft 41, and a plurality of cool air dispersing wings 45. The rotary shaft 41 is installed at the surface of the rear wall of the fresh food compartment 23 in such a way as to allow it to rotate freely. To the upper part of the rotary shaft 41 is connected a driving motor 38 which enables the rotation of the shaft 41. The cool air dispersing wings 45 have a waved strip shape waved to a plane including the rotational axis of the rotary shaft 41. The wings 45 are distanced out from each other along the length of the shaft 41 and are disposed as to correspond to the positions of the cool air discharging openings 36. At the upper and lower end of each cool air dispersing wing 45 are disposed end discs 43 including upper and lower disc **43*a* and 43*b* respectively. Furthermore, between the discs 43*a* and 43*b* is disposed a middle disc 44 which bisects the cool air dispersing wing 45 into a first wing portion 45*a* and a second wing portion 45*b*. Each wing portion 45*a*, 45*b* is curved in such fashion as to have a an "S" shaped cross-section. Within a single cool air dispersing wing 45, the "S" shape of the upper and lower wing portions 45*a* and 45*b*** are reversed to each other.

When the driving motor 38 rotates the rotary shaft 41 at low speed, the cool air supplied through the cool air duct 34 changes its direction of flow according to the curved surface of the cool air dispersing wings 45; and as depicted in FIG. 9, the cool air is blown into the fresh food compartment 23, dispersed to the left and right directions. An even distribution of the cool air in the right and the left side of the fresh food compartment 23 is achieved, and the cool air can be concentrated to one specific region by fixing the cool air dispersing wing's 45 facing direction by stopping the rotation of the rotary shaft 41. It is by such a cool air dispersing device 40 that an evenly distributed refrigeration or a concentrated refrigeration are realized in the fresh food compartment 23.

However, in such a conventional refrigerator, there is a problem of the cool air from the cool air duct 131 directed to the cool air dispersing device 40, not being steadily supplied to the cool air dispersing wings 45, as the itinerary of the cool air in the section between each connecting channel **135*a*, 135*b* and the cool air directing vent 138 meets at a right angle with the itinerary of the same cool air in the section between the cool air directing vent 138 and the cool air dispersing wings 45. Particularly, as depicted in FIG. 10, as the connecting channels 135*a*, 135*b* deliver the cool air to the cool air directing vent 138 from the left and right side respectively, the cool airs from the two sides collide at the rear region of the cool air directing vent 138 and create eddy currents. This results in a delivery of the cool air to the cool air directing vent 138 that is not uniform, with an undesirable effect of some cool air flowing downwards, with the consequence of supplying a greater amount of cool air to the lower cool air guides than to the upper ones. In other words, the refrigeration power in the conventional refrigerator is higher at the lower portion of the fresh food compartment 23. Moreover, the problem is compounded as the collision induced eddies reduce the momentum of the cool air directed to the cool air dispersing device 40; the speed at which the cool air is blowing into the fresh food compartment 23 from the cool air discharging openings 111 is much reduced. Accordingly, a uniform cool air distribution at the rear and front of the fresh food compartment 23** is not realized in the above arrangement.

DISCLOSURE OF INVENTION

Accordingly, the object of the present invention, is to provide a refrigerator in which the eddy effect in the cool air duct is eliminated to allow the cool air guided by the cool air duct to be supplied smoothly and steadily to the cool air dispersing device, and in which the cool air in the said fresh food compartment is distributed evenly in all directions.

The object, according to the present invention, is realized by a refrigerator including a main body housing a fresh food compartment, and a cool air duct provided in a wall of the fresh food compartment and having cool air discharging openings opened toward the fresh food compartment to supply a cool air from an evaporator into the fresh food compartment, the refrigerator comprising: a cool air dispersing wing disposed rotatably near each of the cool air discharging openings to distribute evenly the cool air from the cool air duct through the cool air discharging opening; a rotary shaft for the cool air dispersing wing; a driving means for rotating the rotary shaft; a cool air guide means disposed inside said cool air duct for guiding the cool air flow in the cool air duct toward the cool air dispersing wing.

It is preferred that the cool air guide means comprises a cool air guide member which protrudes from an inner wall surface of the cool air duct and is formed with a cool air guide surface for guiding the cool air.

BRIEF DESCRIPTION OF DRAWINGS

The present invention will be better understood and its various objects and advantages will be more fully appreciated from the following description taken in conjunction with the accompanying drawings in which.

BEST MODE FOR CARRYING OUT THE INVENTION

Hereinafter, the present invention will be described in detail with reference to the drawings. In the illustrated example, the same numerals are assigned to the same parts with the above conventional refrigerators of FIGS. 1 to 10.

Figure 11:
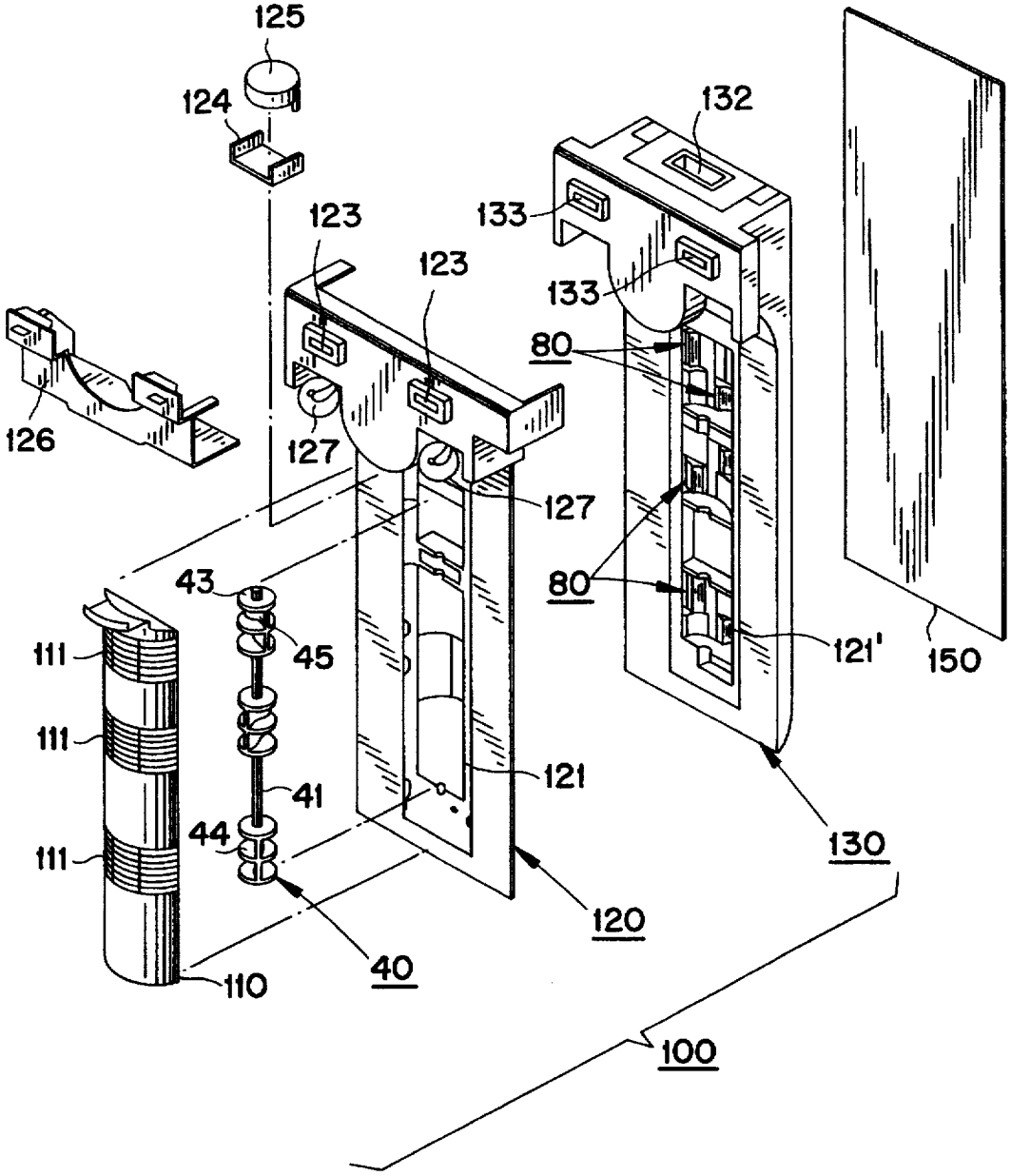
FIG. 11 is a partial exploded perspective view of a refrigerator according to the invention.

FIG. 11 is an partial exploded perspective view of a refrigerator having guide members according to the invention, and shows a duct housing 100. A duct housing 100 forming a cool air duct 131, as in the conventional refrigerator, is comprised of a duct member 130 which guides insulatedly a cool air, a frontal panel 120 which covers up the front side of the duct member 130, a seal panel 150 which covers up the rear side of the duct member 130 and a partially cylindrical cool air grill member 110 disposed at the front side of the frontal panel 120. In the cool air grill member 110 are formed cool air discharging openings 111 facing the fresh food compartment 23. A cool air dispersing device 40 is rotatably installed on the frontal panel 120. The frontal panel 120 and the duct member 130 are formed with recesses 121, 121' for accommodating a portion of the cool air dispersing device 40 to surround the cool air device 40 in cooperation with the cool air grill member 110.

The cool air dispersing device 40, also as in the conventional refrigerator, is comprised of a vertically disposed rotary shaft 41, and cool air dispersing wings 45 which are disposed along the shaft 41 at locations corresponding to the cool air discharging openings 111. The device 40 is put into rotation by means of a driving motor 125 located in the upper part of the frontal panel 120. The cool air dispersing wings 45 have a waved strip shape waved to a plane including the rotational axis of the rotary shaft 41. The wings 45 are distanced out from each other along the length of the shaft 41 and are disposed to correspond to the positions of the cool air discharging openings 111. At the lower and upper end of each cool air dispersing wing 45 are disposed end discs 43 including circular upper and lower end discs **43*a* and 43*b* respectively. Between the discs 43*a* and 43*b* is disposed a middle disc 44 which bisects the cool air dispersing wings 45 into a first wing portion 45*a* and a second wing portion 45*b*. The cool air discharging openings 111 of the cool air grill member 110 are positioned so as to correspond to the locations of the wings 45 on the cool air dispersing device 40**.

In the upper part of the duct member 130 is disposed a conducting path 132 to which the cool air produced at the fresh food compartment evaporator **32*b* is directed into. Inside this conducting path 132 is installed a control damper 79 which regulates the amount of cool air flowing into the path 132 by means of opening/closing this path 132**.

Figure 1:
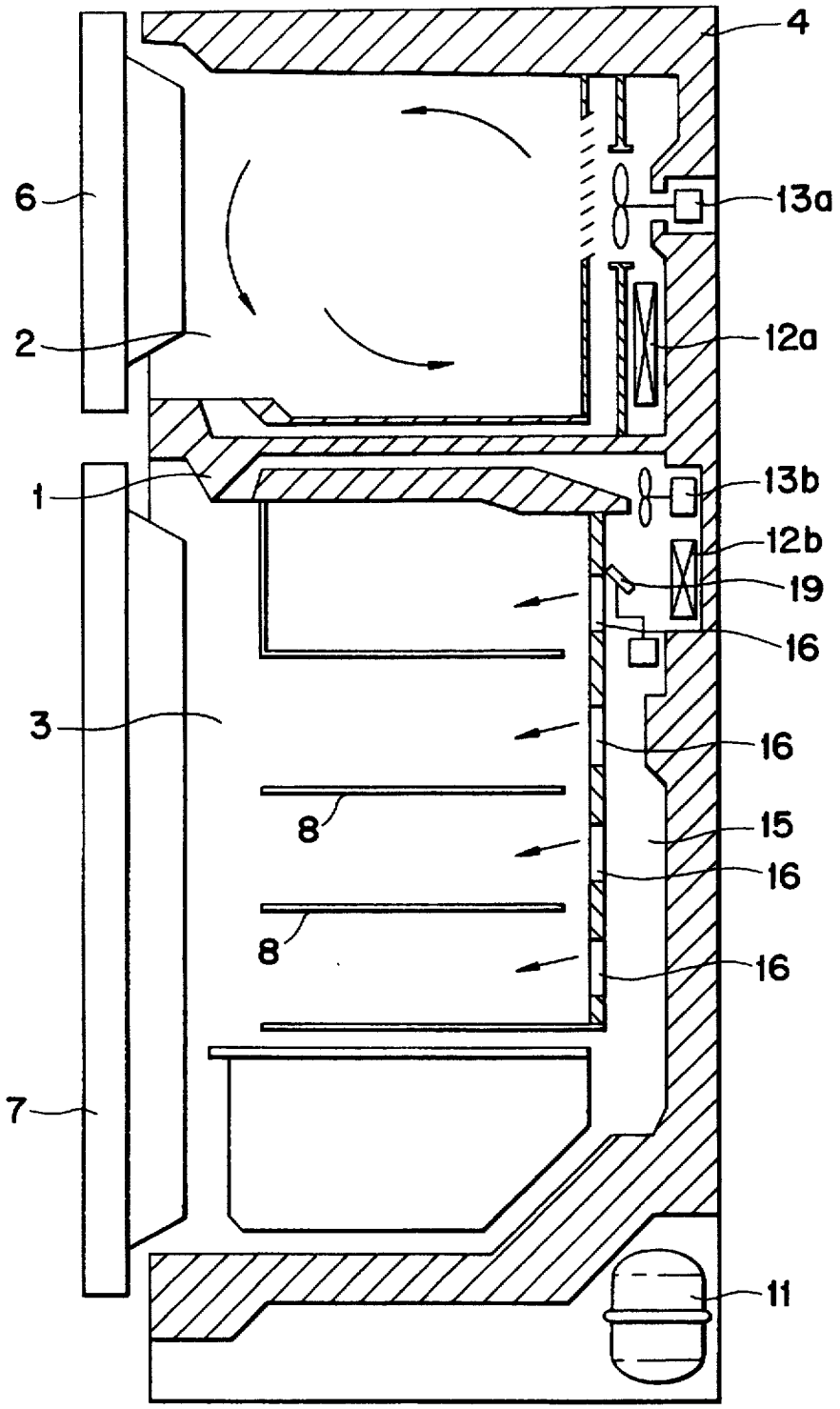
FIG. 1 (PRIOR ART)
FIG. 1 is a side cross-sectional view of a typical refrigerator.
Figure 2:
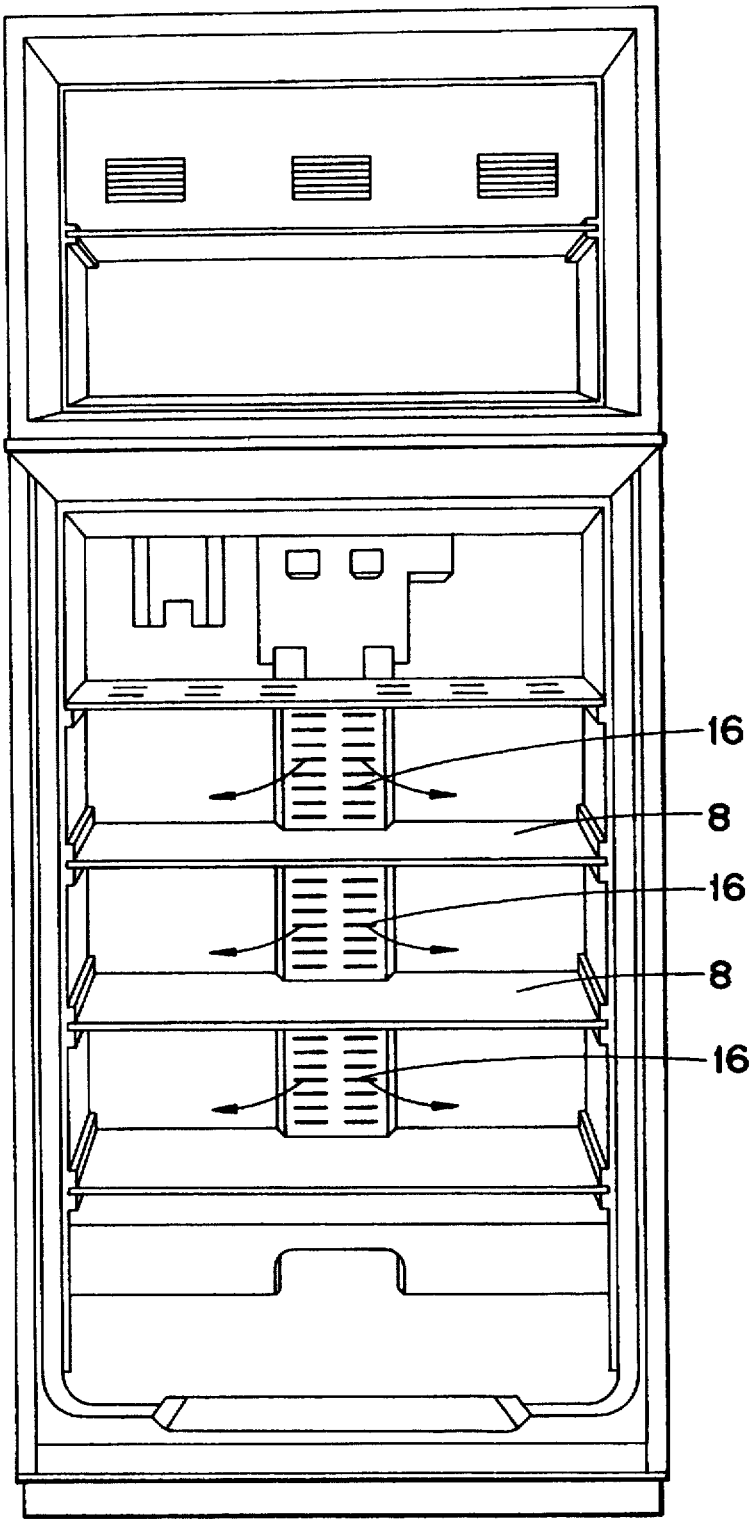
FIG. 2 (PRIOR ART)
FIG. 2 is a front view of the inside of the refrigerator adopting a shelf-by-shelf cooling method.
Figure 3:
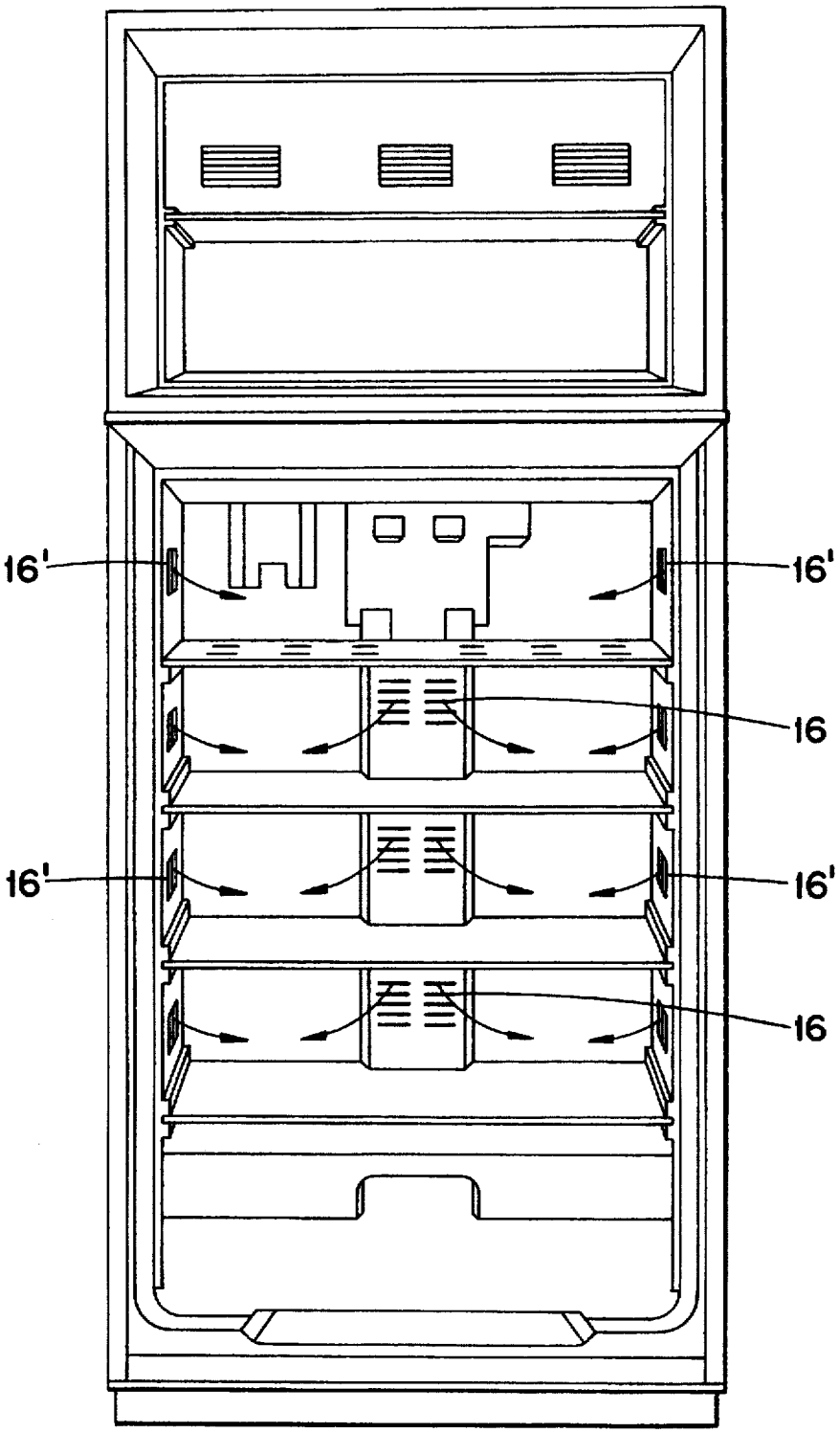
FIG. 3 (PRIOR ART)
FIG. 3 is a front view of the inside of another conventional refrigerator adopting a tri-dimensional cooling method.
Figure 4:
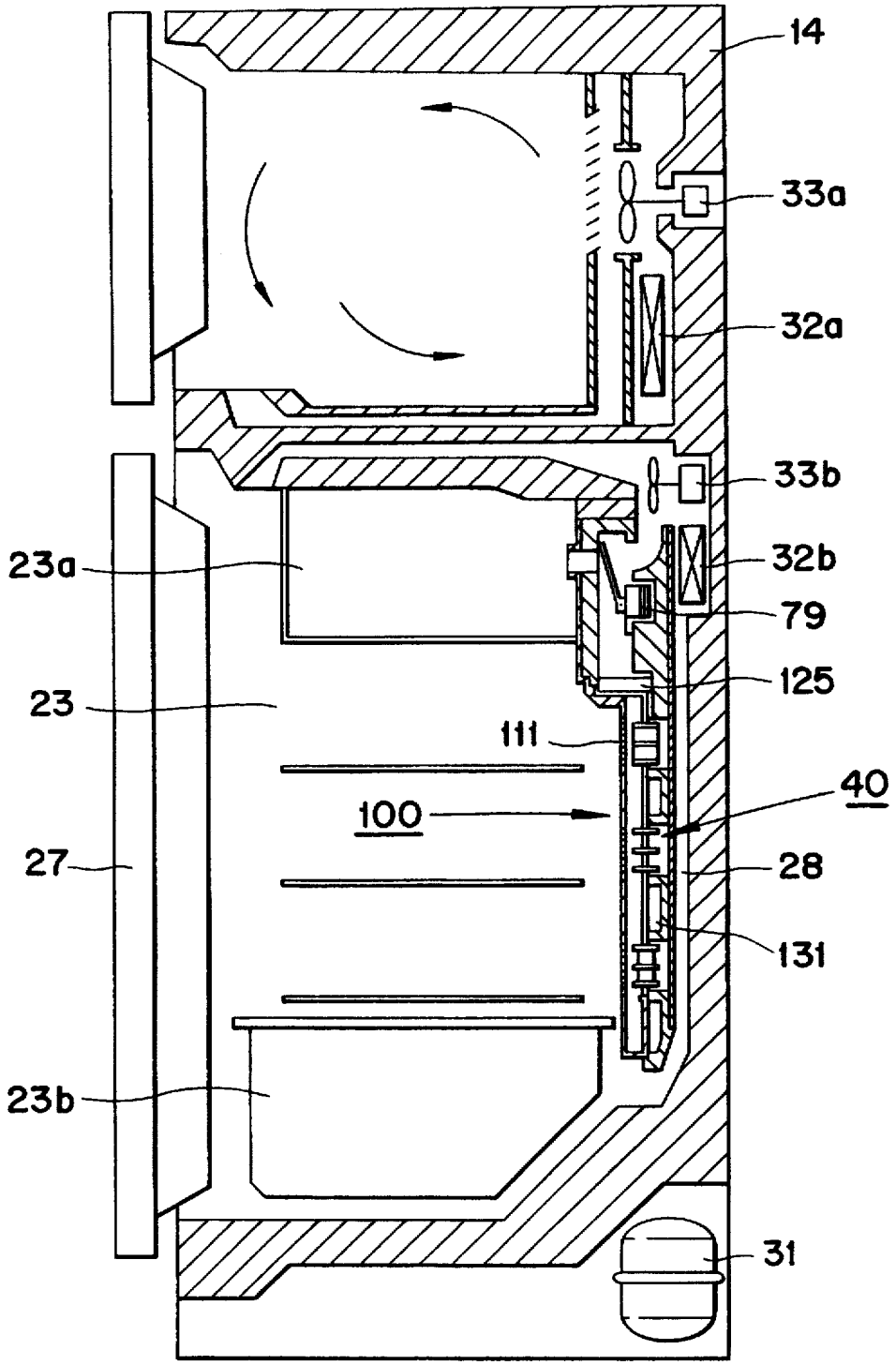
FIG. 4 (PRIOR ART)
FIG. 4 is a side cross-sectional view of yet another refrigerator provided with a cool air dispersing device.
Figure 5:
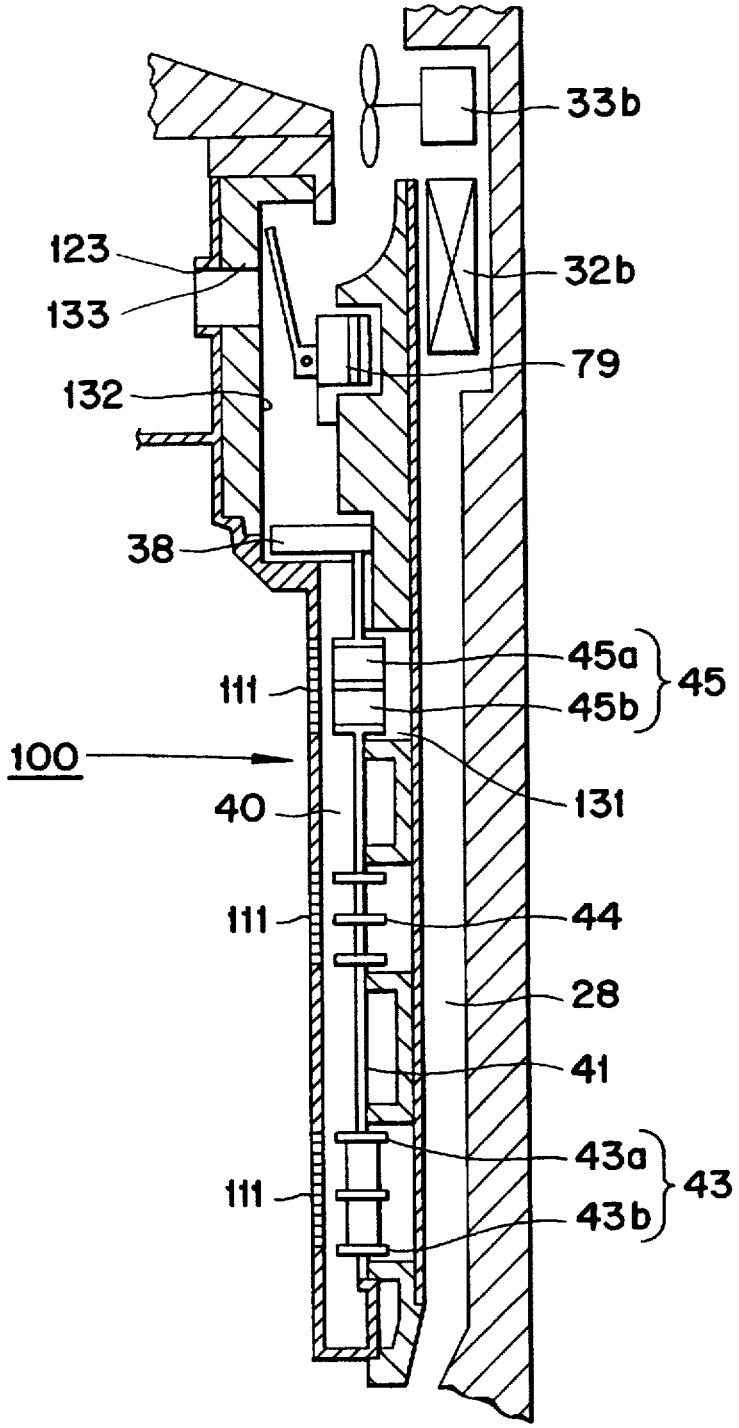
FIG. 5 (PRIOR ART)
FIG. 5 is a partially enlarged sectional view of FIG. 4.
Figure 6:
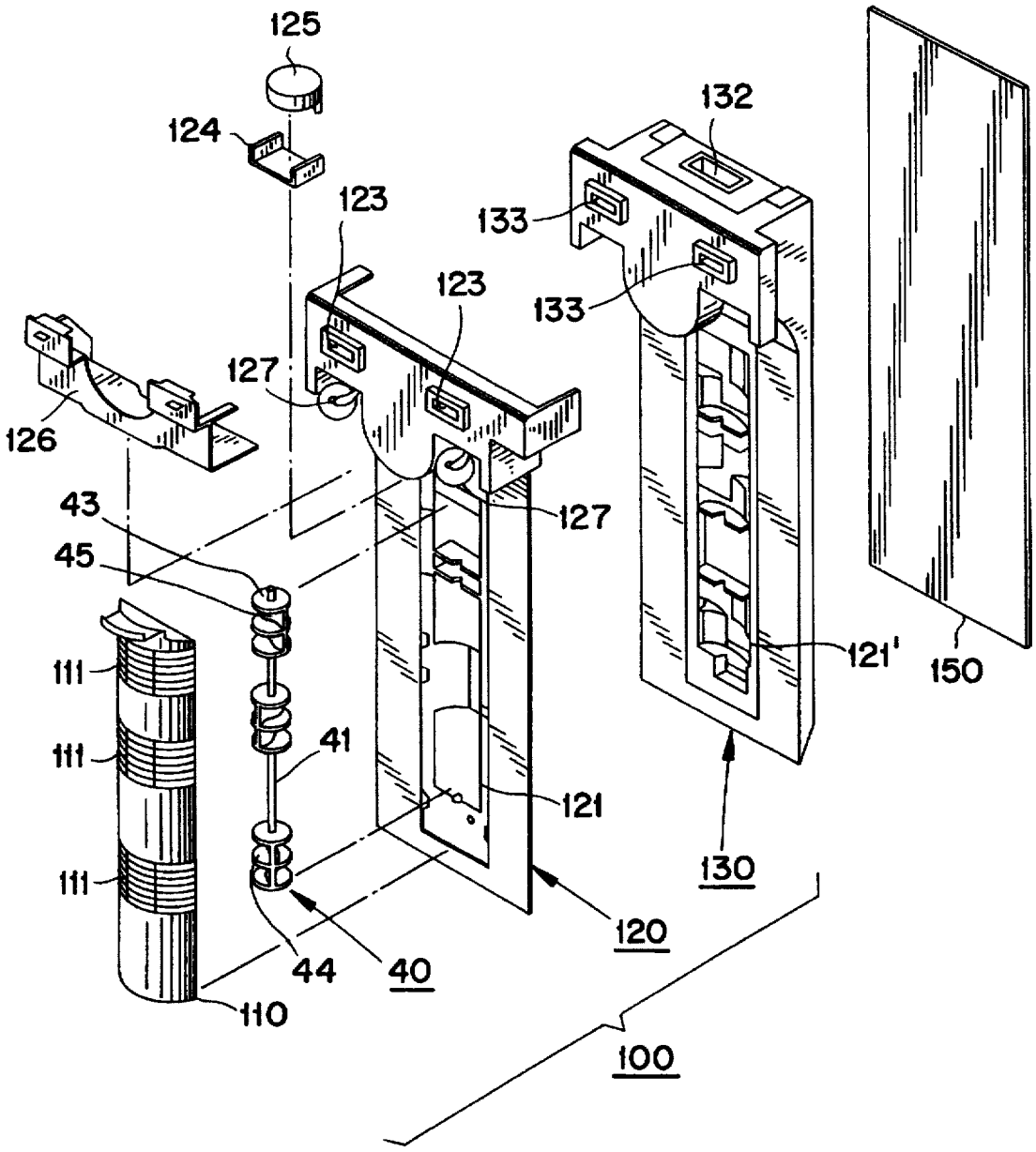
FIG. 6 (PRIOR ART)
FIG. 6 is an exploded perspective view of FIG. 5.
Figure 7:
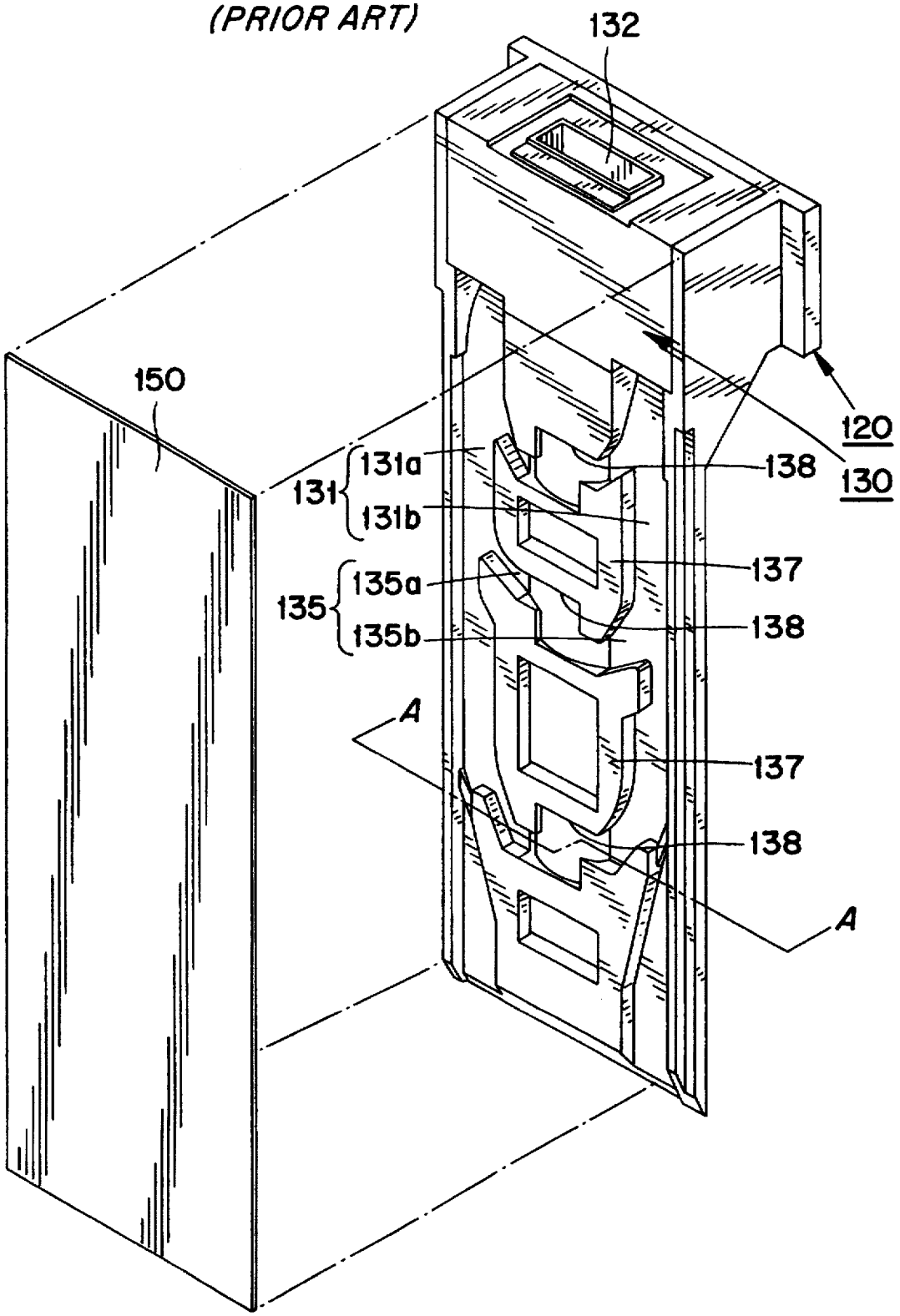
FIG. 7 (PRIOR ART)
FIG. 7 is a rear perspective view of FIG. 6 showing the coupled state of a duct member and a frontal panel.
Figure 8:
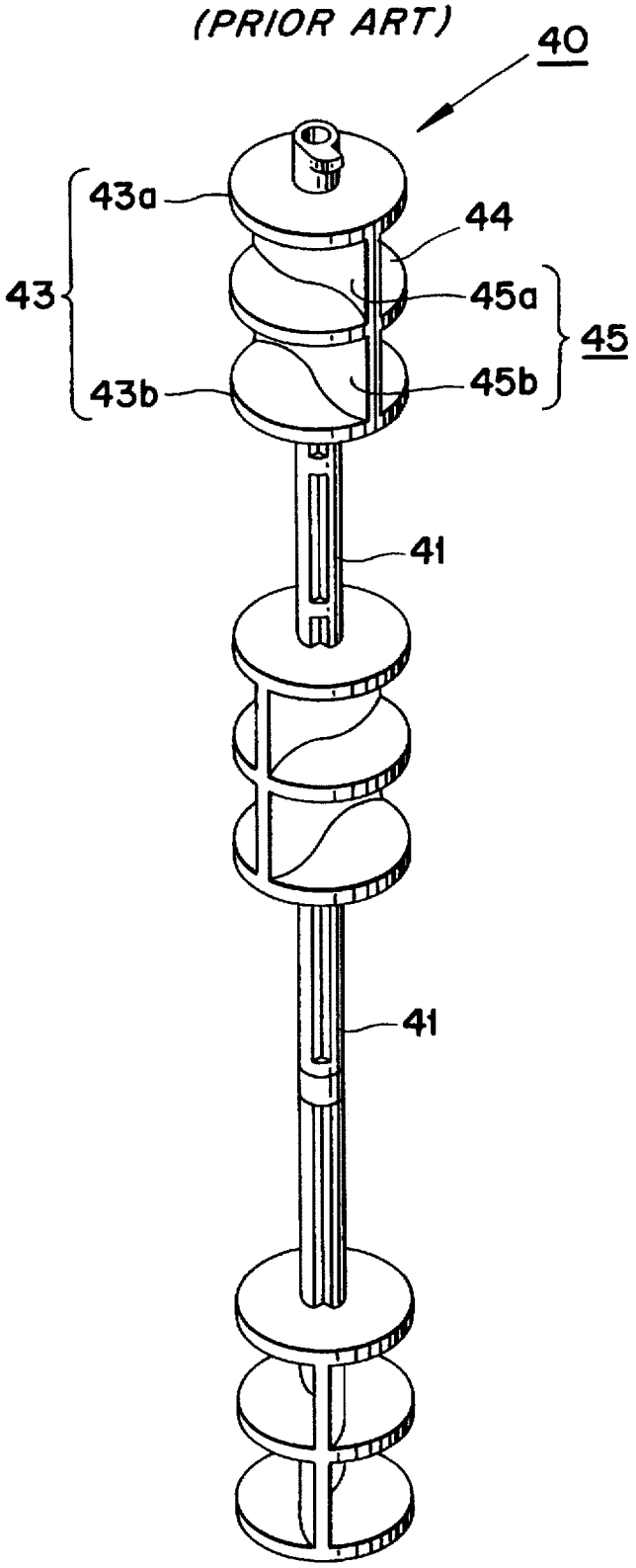
FIG. 8 (PRIOR ART)
FIG. 8 is an enlarged perspective view of the cool air dispersing device of FIG. 5.
Figure 9:
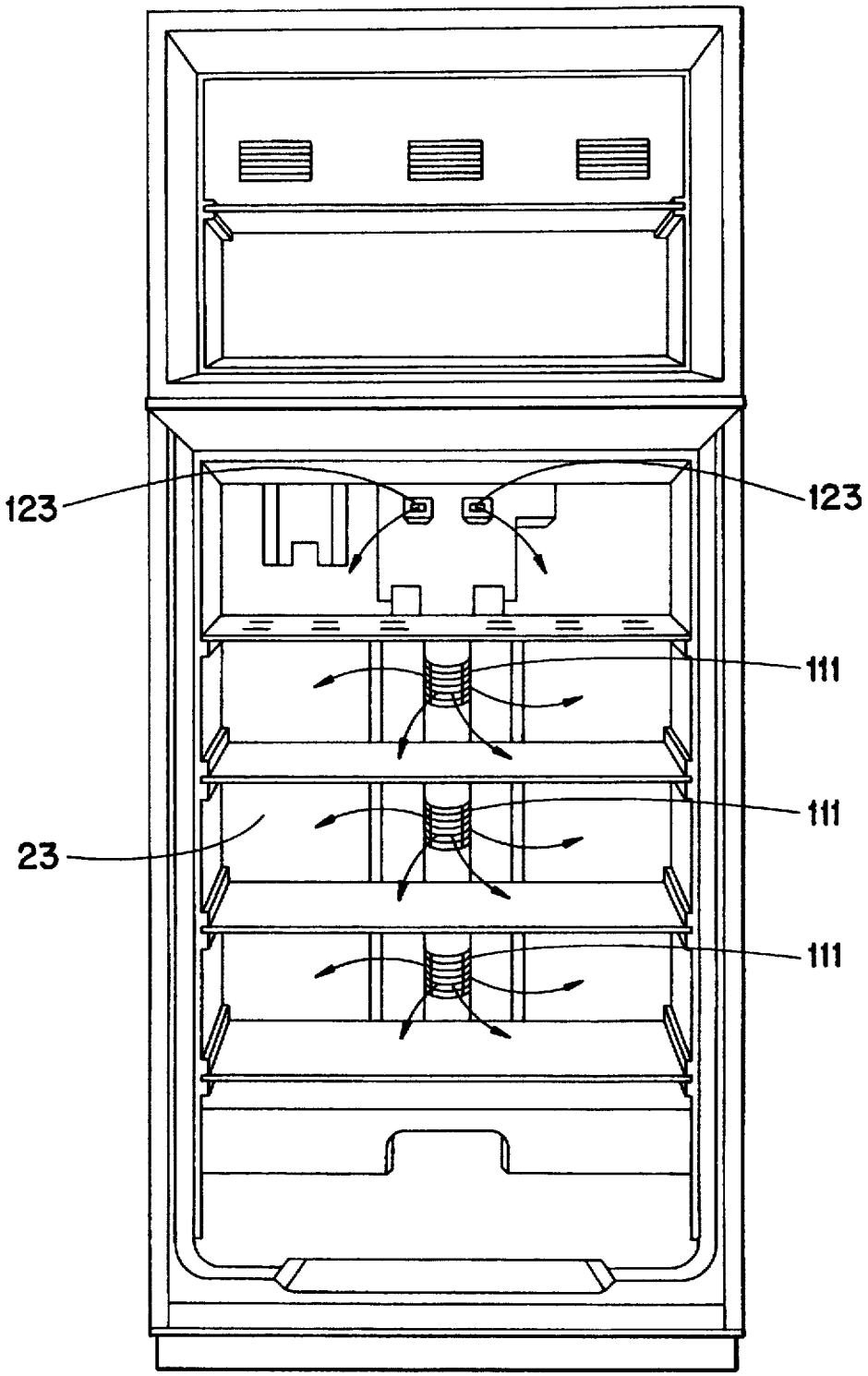
FIG. 9 (PRIOR ART)
FIG. 9 is a front view of the inside of the refrigerator in FIG. 4.
Figure 10:
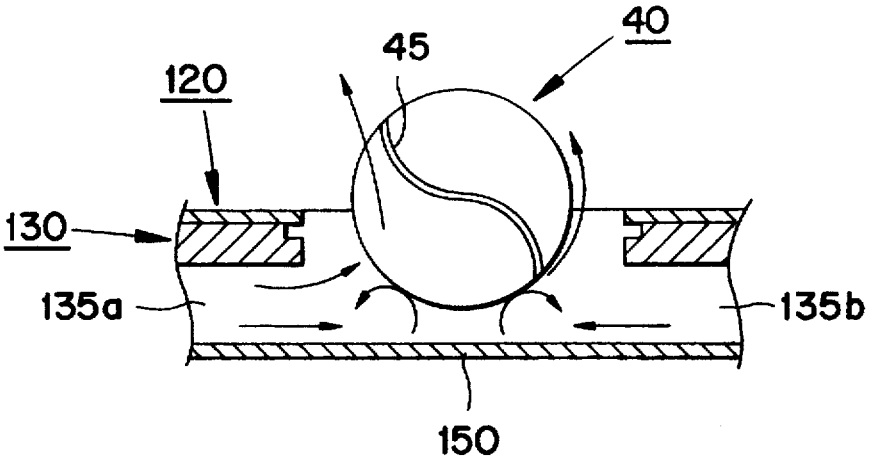
FIG. 10 (PRIOR ART)
FIG. 10 is a partial sectional view taken along the line A—A in FIG.7.
Figure 13:
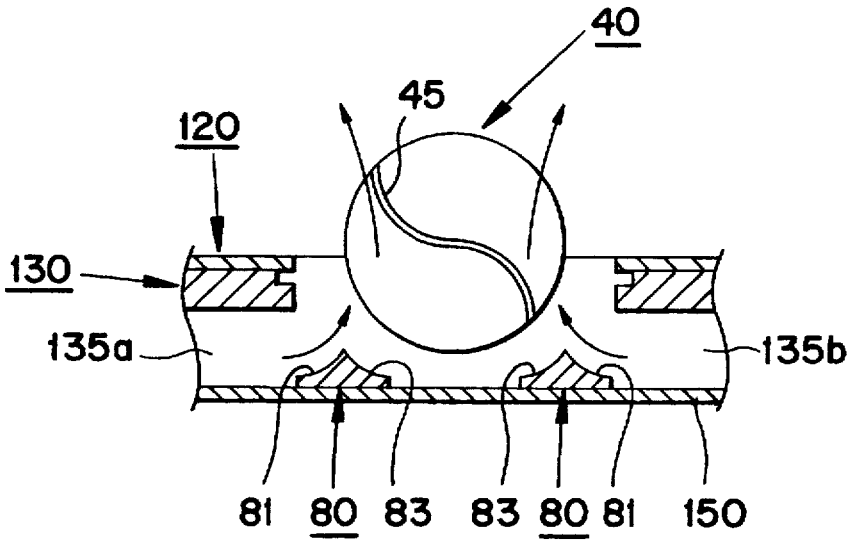
FIG. 13 is a partial sectional view taken along the line B—B in FIG. 12.
Figure 12:
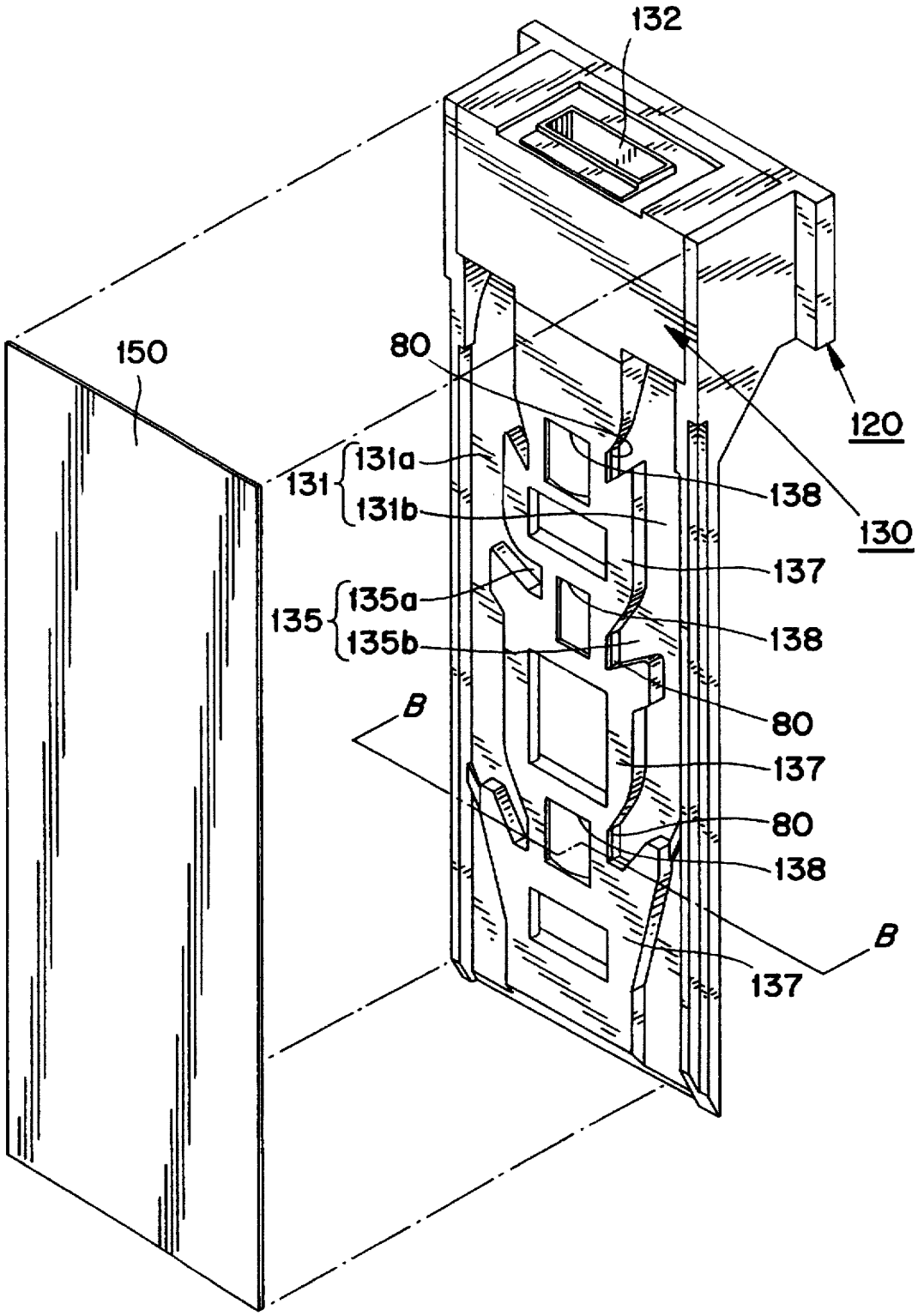
FIG. 12 is a rear perspective view of FIG. 11 showing the coupled state of a duct member and a frontal panel.

FIG. 12 is a rear perspective view of FIG. 11 showing a coupled state of the duct member and the frontal panel. FIG. 13 is a partially cross-sectional view of FIG. 12 taken along the B—B line. In the rear surface of the duct member 130 are disposed a plurality of cool air guides 137. In between the cool air guides 137 are formed cool air directing vents 138 which pass through the duct member 130. Each cool air directing vent 138 is disposed to correspond to the locations of the cool air dispersing wings 45 of the cool air device 40.

As in the conventional refrigerator, the cool air duct 131 is composed of a first duct portion **131*a* and a second duct portion 131*b* with the cool air guides 137 separating the two. Each duct portion 131*a*, 131*b* is linked to the cool air directing vents 138 by the first and second connecting paths, or cool air paths, 135*a*, 135*b* formed by the cool air guide 137. Those paths 135*a*, 135*b* conduct respective flows of cool air toward one another. A wing 45 of the cool air dispensing device 40 is situated at a location where the paths 135*a*, 135*b*** come together.

A seal panel 150 is placed virtually conforming to the rear surface of the duct member 130, and forms the rear wall of the cool air duct 131. The duct member 130 and the seal panel 150 are made of insulating material such as polystyrene foam and prevent the transfer loss of cool air.

At an end region near the cool air directing vent 138 of each connecting path **135*a*, 135*b* is disposed a guide member 80 according to this invention which contact hermetically to the inner wall of the seal panel 150. The guide member 80, as illustrated in FIG. 13, is protruding from the seal panel 150 out to the cool air directing vent 138, and includes a curved inclined cool air guide surface 81 which guides the cool air from the connecting paths 135***a*, 135*b* to the cool air dispersing device 40. The movement of the cool air along the seal panel 150 from the two (left and right) connecting paths 135*a*, 135*b* are guided away from the seal panel 150 and toward the cool air dispersing device 40 by the cool air guide surfaces 81 which face away from one another. As a result, the current of cool air from the two connecting paths 135*a*, 135*b* is diverted by about 90° degrees from paths 135*a*, 135*b* to the cool air dispersing device 40 without the two currents colliding. The cool air is discharged into the fresh food compartment 23 without any loss of speed through the cool air discharging openings 111 of the cool air grill member 110 via the cool dispersing wing 45. Furthermore, the eddies resulting from the collision of cool airs coming from the two connecting paths 135*a*, 135*b* are also avoided.

The guide members 80 comprises a second set of symmetrically sloped surfaces 83. These inclined surfaces 83 are curved to match the rotational path of the cool air dispersing wing 45. The function of these surfaces 83 is to reduce the cool air drag which could result from the protuberance of the guide member 80.

The guide member 80 can be fabricated separately and attached later to the duct member 130. It is preferable however, that it is integrated to the duct member 130. It can also be made as an integrated part of the seal panel 150, in which it occupies a region of the seal panel 150 which is in the proximity of the cool air directing vent 138 of the connecting paths 135*a*, 135*b* when the seal panel 150 is fitted to the duct member 130.

On the other hand, the cool air dispersing wing can be fabricated in various forms such as spiral structure or a plurality of inclined panels.

INDUSTRIAL APPLICABILITY

As explained above, according to the present invention, a refrigerator in which the eddy effect in the cool air duct is eliminated, and in which the cool air guided by the cool air duct is supplied smoothy and steadily to the cool air dispersing device, and in which the cool air in the fresh food compartment is distributed evenly in all directions, is provided.

What is claimed is:

1. A refrigerator comprising:

a main body forming a fresh food compartment;

an evaporator in the main body for generating cool air;

a cool air duct housing disposed on a wall of the compartment and having cool air discharge openings communicating with the compartment to supply cool air into the compartment;

each of the discharge openings communicating with first and second cool air paths for supplying the discharge outlet with cool air from the evaporator, the first and second paths conducting respective flows of cool air toward one another;

a cool air dispensing device mounted for rotation in the duct housing and including air dispersing wings arranged in respective discharge openings, each wing situated at a location where the first and second paths come together;

a driving device for rotating the dispersing device; and first and second cool air guide elements disposed in the first and second paths, respectively, adjacent the associated air dispersing wing, each guide element including a generally curved guide surface, the guide surfaces facing away from one another and arranged for preventing the first and second air flows from colliding with one another by diverting the respective air flows by generally ninety degrees toward the respective air dispersing wing.

2. The refrigerator according to claim 1 wherein each of the guide elements includes an additional curved surface, the additional curved surfaces facing one another and being curved to match a rotational path of the air dispersing wing for minimizing air drag.

* * * * *